United States Patent [19]

Limburg et al.

[11] 4,053,311

[45] Oct. 11, 1977

[54] POLY-N-VINYLCARBAZOLE IMAGE TRANSPORT LAYER PLASTICIZED BY BIS(4-DIETHYLAMINO-2-METHYL-PHENYL)PHENYLMETHANE

[76] Inventors: William W. Limburg, Penfield; John F. Yanus, Webster; Damodar M. Pai, Fairport, all of N.Y.

[21] Appl. No.: 673,236

[22] Filed: Apr. 2, 1976

[51] Int. Cl.[2] ..... G03G 5/04; G03G 5/06; G03G 5/08

[52] U.S. Cl. ..... 96/1 PC; 96/1.5 N; 96/1.6; 252/501

[58] Field of Search ..... 96/1.5, 1.6, 1 PC; 252/501; 260/32.4

[56] References Cited

U.S. PATENT DOCUMENTS

| | | | |
|---|---|---|---|
| 3,533,783 | 10/1970 | Robinson | 96/1.5 |
| 3,647,432 | 3/1972 | Holstead | 96/1.5 |
| 3,765,883 | 10/1973 | Endo et al. | 96/1.5 |
| 3,820,989 | 6/1974 | Rule et al. | 96/1.5 |
| 3,937,631 | 2/1976 | Eisenhut | 96/1.5 |
| 3,961,953 | 6/1976 | Millonzi et al. | 96/1.5 |

*Primary Examiner*—Roland E. Martin, Jr.
*Attorney, Agent, or Firm*—James J. Ralabate; James Paul O'Sullivan; Ronald L. Lyons

[57] ABSTRACT

A photosensitive member having at least two electrically operative layers is disclosed. The first layer comprises a photoconductive layer which is capable of photogenerating holes and injecting the photogenerated holes into a contiguous charge transport layer. The charge transport layer comprises poly(N-vinylcarbazole) which contains an electrically active plasticizer comprising from about 1 to about 25 percent by weight of bis(4-diethylamino-2-methylphenyl)-phenylmethane. The charge transport layer while substantially non-absorbing in the spectral region of intended use, is "active" in that it allows injection of photo-generated holes from the photoconductive layer, and allows these holes to be transported through the charge transport layer. This structure may be imaged in the conventional xerographic mode which usually includes charging, exposure to light and development.

18 Claims, 4 Drawing Figures

POLY-N-VINYLCARBAZOLE IMAGE TRANSPORT LAYER PLASTICIZED BY BIS(4-DIETHYLAMINO-2-METHYLPHENYL)-PHENYLMETHANE

BACKGROUND OF THE INVENTION

This invention relates in general to xerography and, more specifically, to a novel photosensitive device and method of use.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated by U.S. Pat. No. 3,121,006 to Middleton and Reynolds which describes a number of binder layers comprising finely divided particles of a photoconductive inorganic compound dispersed in an electrically insulating organic resin binder. In its present commercial form, the binder layer contains particles of zinc oxide uniformly dispersed in a resin binder and is coated on a paper backing.

In the particular examples described in Middleton et al, the binder comprises a material which is incapable of transporting injected charge carriers generated by the photoconductor particles for any significant distance. As a result, with the particular material disclosed in Middleton et al patent, the photoconductor particles must be, in substantially continuous particle-to-particle contact throughout the layer in order to permit the charge dissipation required for stable cyclic operation. Therefore, with the uniform dispersion of photoconductor particles described in Middleton et al, a relatively high volume concentration of photoconductor, about 50 percent by volume, is usually necessary in order to obtain sufficient photoconductor particle-to-particle contact for rapid discharge. However, it has been found that high photoconductor loadings in the binder results in the physical continuity of the resin being destroyed, thereby significantly reducing the mechanical properties of the binder layer. Systems with high photoconductor loadings are often characterized as having little or no flexibility. On the other hand, when the photoconductor concentration is reduced appreciably below about 50 percent by volume, the photo-induced discharge rate is reduced, making high speed cyclic or repeated imaging difficult or impossible.

U.S. Pat. No. 3,121,007 to Middleton et al teaches another type of photoreceptor which inclues a two-phase photoconductive binder layer comprising photoconductive insulating particles dispersed in a homogeneous photoconductive insulating matrix. The photoreceptor is in the form of a particulate photoconductive inorganic pigment broadly disclosed as being present in an amount from about 5 to 80 percent by weight. Photodischarge is said to be caused by the combination of charge carriers generated in the photoconductive insulating matrix material and charge carriers injected from the photoconductive pigment into the photoconductive insulating matrix.

U.S. Pat. No. 3,037,861 to Hoegl et al teaches that poly(vinylcarbazole) exhibits some long-wave U.V. sensitivity and suggests that its spectral sensitivity be extended into the visible spectrum by the addition of dye sensitizers. Hoegl et al further suggest that other additives such as zinc oxide or titanium dioxide may also be used in conjunction with poly(vinylcarbazole). In Hoegl et al, the poly(vinylcarbazole) is intended to be used as a photoconductor, with or without additive materials which extend its spectral sensitivity.

In addition to the above, certain specialized layered structures particularly designed for reflex imaging have been proposed. For example, U.S. Pat. No. 3,165,405 to Hoesterey utilizes a two layered zinc oxide binder structure for reflex imaging. The Hoesterey patent utilizes two separate contiguous photoconductive layers having different spectral sensitivies in order to carry out a particular reflex imaging sequence. The Hoesterey device utilizes the properties of multiple photoconductive layers in order to obtain the combined advantages of the separate photoresponse of the respective photoconductive layers.

It can be seen from a review of the conventional composite photoconductive layers cited above, that upon exposure to light, photoconductivity in the layer structure is accomplished by charge transport through the bulk of the photoconductive layer, as in the case of vitreous selenium (and other homogeneous layered modifications). In devices employing photoconductive binder structures which include inactive electrically insulating resins such as those described in the Middleton et al, U.S. Pat. No. 3,121,006, conductivity or charge transport is accomplished through high loadings of the photoconductive pigment allowing particle-to-particle contact of the photoconductive particles. In the case of photoconductive particles dispersed in a photoconductive matrix, such as illustrated by the Middleton et al U.S. Pat. No. 3,121,007, photoconductivity occurs through the generation and transport of charge carriers in both the photoconductive matrix and the photoconductor pigment paricles.

Although the above patents rely upon distinct mechanisms of discharge throughout the photoconductive layer, they generally suffer from common deficiencies in that the photoconductive surface during operation is exposed to the surrounding environment, and particularly in the case of repetitive xerographic cycling where these photoconductive layers are susceptible to abrasion, chemical attack, heat and multiple exposures to light. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoreceptors require that the photoconductor comprise either a hundred percent of the layer, as in the case of the vitreous selenium layer, or capability they preferably contain a high proportion of photoconductive material in the binder configuration. The requirements of a photoconductive layer containing all or a major proportion of a photoconductive material further restricts the physical characteristics of the final plate, drum or belt in that the physical characteristics such as flexibility and adhesion of the photoconductor to a supporting substrate are primarily dictated by the physical properties -methylphenyl)phenylmethane. the photoconductor, and not by the resin or matrix material which is preferably present in a minor amount.

Another form of a composite photosensitive layer which has also been considered by the prior art includes a layer of photocoductive material which is covered with a relatively thick plastic layer and coated on a supporting substrate.

U.S. Pat. No. 3,041,166 to Bardeen describes such a configuration in which a transparent plastic material overlays a layer of vitreous selenium which is contained on a supporting substrate. In operation, the free surface of the transparent plastic is electrostatically charged to a given polarity. The device is then exposed to activating radiation which generates a hole-electron pair in the photoconductive layer. The electrons move through the plastic layer and neutralize positive charges on the free surface of the plastic layer thereby creating an electrostatic image. Bardeen, however, does not teach any specific plastic materials which will function in this manner, and confines his examples to structures which use a photoconductor material for the top layer.

French Pat. No. 1,577,855 to Herrick et al describes a special purpose photosensitive device adapted for reflex exposure by polarized light. One embodiment which employs a layer of dichroic organic photoconductive particles arrayed in oriented fashion on a supporting substrate and a layer of poly(vinylcarbazole) formed over the oriented layer of dichoric material. When charged and exposed to light polarized perpendicularly to the orientation of the dichroic layer, the oriented dichoric layer and poly(vinylcarbazole) layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of polyvinyl carbazole.

Shattuck et al, U.S. Pat. No. 3,837,851, discloses a particular electrophotographic member having a charge generation layer and a separate charge transport layer. The charge transport layer comprises at least one tri-aryl pyrazoline compound. These pyrazoline compounds may be dispersed in binder material such as resins known in the art.

Cherry et al, U.S. Pat. No. 3,791,826, discloses an electrophotographic member comprising a conductive substrate, a barrier layer, an inorganic charge generation layer and an organic charge transport layer comprising at least 20 percent by weight trinitrofluorenone.

Belgian Pat. No. 763,540, issued Aug. 26, 1971 (U.S. application Ser. No. 94,139, filed Dec. 1, 1970, now abandoned) discloses an electrophotographic member having at least two electrically operative layers. The first layer comprises a photoconductive layer which is capable of photogenerating charge carriers and injecting the photo-generated holes into a contiguous active layer. The active layer comprises a transparent organic material which is substantially non-absorbing in the spectral region of intended use, but which is active in that it allows injection of photo-generated holes from the photoconductive layer, and allows these holes to be transported to the active layer. The active polymers may be mixed with inactive polymers or nonpolymeric material.

Wilson, U.S. Pat. No. 3,542,547, discloses photoconductive elements containing stable organic photoconductors such as triarylmethane leuco bases. More specifically, Wilson discloses a photoconductive element for use in electrophotography comprising a support havng coated thereon a photoconductive insulating layer which comprises an organic photoconductor dispersed in a film-forming insulating resin binder. The photoconductor may be 4,4'-bis(diethylamino)-2,2'-dimethyltriphenylmethane.

Rule et al, U.S. pat. No. 3,820,989, discloses certain triarylmethane leuco bases which may be used as photoconductive materials dispersed in an insulating resin binder.

Robinson, U.S. Pat. No. 3,533,783, discloses a photoconductive element which comprises a conductive support having coated thereon a layer of a composition comprising a binder, a sensitizer and an organic photoconductor which is overcoated with a layer of a composition comprising a binder and an organic photoconductor. The organic photoconductor may be 4,4'-diethylamino-2,2'-dimethyltriphenylmethane.

Gilman, Defensive Publication of Ser. No. 93,449 filed Nov. 27, 1970, published in 888 O.G. 707 on July 20, 1970, Defensive Publication No. P888,013, U.S. Cl. 96-1.5, discloses that the speed of an inorganic photoconductor such as amorphous selenium, can be improved by including an organic photoconductor in the electrophotographic element. For example, an insulating resin binder may have $TiO_2$ dispersed therein or it may be a layer of amorphous selenium. This layer is overcoated with a layer of electrically insulating binder resin having an organic photoconductor such as 4,4'-diethylamino-2,2'-dimethyltriphenylmethane dispersed therein.

"Multi-Active Photoconductive Element," Martin A. Berwick, Charles J. Fox and William A. Light, Research Disclosure, Vol. 133; pages 38–43, May 1975, was published by Industrial Opportunities Ltd. Homewell, Havant, Hampshire, England. This disclosure relates to a photoconductive element having at least two layers comprising an organic photoconductor containing a charge-transport layer in electrical contact with an aggregate charge-generation layer. Both the charge-generation layer and the charge-transport layer are essentially organic compositions. The charge-generation layer contains a continuous electrically insulating polymer phase and a discontinuous phase comprising a finely-divided, particulate co-crystalline complex of (1) at least one polymer having an alkylidene diarylene group in a recurring unit and (2) at least one pyrylium-type dye salt. The charge-transport layer is an organic material which is capable of accepting and transporting injected charge carriers from the charge-generation layer. This layer may comprise an insulating resinous material having 4,4'-bis(diethylamino)-2,2'-dimethyltriphenylmethane dispersed therein.

None of the above mentioned art discloses charge generating material in a separate layer which is overcoated with a charge-transport layer comprising poly(N-vinylcarbazole) which contains an electrically active plasticizer comprising from about 1 to about 25 percent by weight of bis(4-diethylamino-2-methylphenyl)phenylmethane wherein the charge transport material is substantially non-absorbing in the spectral region of intended use, but which is active in that it allows injection of photo-generated holes from the charge-generation layer and allows these holes to be transported therethrough. The charge-generating layer is a photoconductive layer which is capable of photogenerating holes and injecting these holes into the contiguous charge-transport layer.

Most importantly, it is well known that when poly(N-vinylcarbazole) is used in a flexible, belt type photoreceptor, it becomes brittle with little or no flexibility after extensive cycling. When normal plasticizers, e.g., dibutylphthalate, are added to plasticize poly(N-vinylcarbazle), the addition of these plasticizers adversely affect the electrical properties of the poly(N-vinylcarbazole). The plasticized poly(N-vinylcarbazole), when used as the transport layer, is not capable of allowing efficient transport of photo-generated holes injected from the photoconductive layer. Therefore, the instant invention overcomes this difficulty by using a plasticizer which is referred to in the instant invention as an electrically active plasticizer. This plasticizer, bis(4-diethylamino-2-methylphenyl)phenylmethane is added in plasticizing amounts, i.e., from abouut 1 to about 25 percent by weight, to the poly(N-vinylcarbazole). The above electrical disadvantages were overcome and the poly(N-vinylcarbazole) was plasticized so that it would remain flexible and non-brittle when used in an application requiring a flexible, photoreceptor which after extended cycling still retains its original electrical properties.

OBJECT OF THE INVENTION

It is an object of this invention to provide a novel imaging system.

It is a further object of this invention to provide a novel photoconductive element adapted for cyclic imaging which overcomes the above-noted disadvantages.

It is a further object of this invention to provide a photoconductive member comprising a generating layer and a charge transport layer comprising an electrically active plasticizer, i.e., bis(4-diethylamino-2-methylphenyl)phenylmethane dispersed therein.

It is another object of this invention to provide a novel imaging member capable of remaining both (1) flexible and (2) non-brittle while still retaining its electrical properties after extensive cycling.

SUMMARY OF THE INVENTION

The foregoing objects and others are accomplished in accordance with this invention by providing a photoconductive member having at least two operative layers. The first layer comprises a material which is capable of photogenerating holes and injecting the photogenerated holes into a contiguous or adjacent electrically active layer, i.e., a charge transport layer. The active material, i.e., charge transport layer, comprises poly(N-vinylcarbazole) having dispersed therein an electrically active plasticizer comprising from about 1 to about 25 percent by weight of bis(4-diethylamino-2-methylphenyl)phenylmethane. The active layer, i.e., the charge transport layer, is substantially non-absorbing to visible light or radiation in the region of intended use, but is active in that it allows the injection of photogenerated holes from the photoconductive layer and allows these holes to be transported through the active layer to selectively discharge a surface charge on the surface of the active layer.

It is well known that when poly(N-vinylcarbazole) is used alone as the transport layer in a photosensitive member comprising two operative layers (1) a charge transport layer overlying (2) a charge generation layer, that when this member is extensively cycled, e.g., in a mode requiring flexing, such as, a belt configuration, the poly(N-vinylcarbazole) becomes brittle and non-flexible, e.g., 1000 cycles or more. Therefore, it became necessary to add plasticizers to the poly(N-vinylcarbazole). Upon the addition of conventional plasticizers, e.g., dibutylphthalate, etc., the physical properties of the poly(N-vinylcarbazole) were improved so that extensive cycling could be accomplished with this member without the poly(N-vinylcarbazole) becoming non-flexible and brittle. However, the electrical properties of the poly(N-vinylcarbazole) became unacceptable. This layer would not allow acceptable transport of holes photo-generated in and injected from the photoconductive layer in order to discharge a surface charge on the free surface of the active layer in order to form an acceptable electrostatic latent image. Therefore, it was unexpectedly discovered that the addition of small amounts of bis(4-diethylamino-2-methylphenyl)-phenylmethane to the poly(N-vinylcarbazole) acted as a plasticizer and there was no need for the addition of normal plasticizers, e.g., dibutylphthalate. Unexpectedly, the poly(N-vinylcarbazole) containing the bis(4-diethylamino-2-methylphenyl)phenylmethane when used as a transport material showed excellent physical properties, i.e., flexibility and non-brittleness, after extensive cycling, e.g., 1000 cycles, and continued to show excellent electrical properties, that is, this charge transport layer allowed the injection of photogenerated holes from the photoconductive layer and allowed a sufficient amount or an acceptable amount of these holes to be transported through the active layer to selectively and acceptably discharge a surface charge on the free surface of the active layer thereby forming an acceptable electrostatic latent image. Therefore, it was unexpected that the addition of from about 1 to about 25 percent by weight of bis(4-diethylamino-2-methylphenyl)phenylmethane to the poly(N-vinylcarbazole) would improve the physical properties, i.e., flexibility and prevent brittleness upon cycling, thereby plasticizing the poly(N-vinylcarbazole) without adversely affecting the electrical properties of this layer. Therefore, unexpectedly, the electrical properties of poly(N-vinylcarbazole) were not affected by the addition of this plasticizer which is now herein referred to as electrically active plasticizer. By the use of the term electrically active plasticizer, it is meant that the material, e.g., bis(4-diethylamino-2-methylphenyl)phenylmethane, when added to the poly(N-vinylcarbazole) does indeed plasticize the poly(N-vinylcarbazole). However, in addition to plasticizing the poly(N-vinylcarbazole) this material, e.g., bis(4-diethylamino-2-methylphenyl)-phenylmethane, in amounts of from about 1 to about 25 percent by weight does not detrimentally affect the electrical properties of the poly)N-vinylcarbazole) when the poly(N-vinylcarbazole) is used as a charge transport material.

It should be understood that the poly(N-vinylcarbazole) containing from about 1 to about 25 percent by weight of bis(4-diethylamino-2-methylphenyl)-phenylmethane as an electrically active plasticizer, does not function as a photoconductor in the wavelength region of intended use. As stated above, hole electron pairs are photogenerated in the photoconductive layer and the holes are then injected into this active layer and hole transport occurs through this active layer.

A typical application of the instant invention involves the use of a layered configuration member which in one embodiment consists of a supporting substrate such as a conductor containing a photoconductive layer thereon. For example, the photoconductive layer may be in the form of amorphous, vitreous or trigonal selenium. A transparent layer of poly(N-vinylcarbazole) having dispersed therein a plasticizing amount of bis(4-diethylamino-2-methylphenyl)phenylmethane which allows for hole injection and transport, is coated over the selenium photoconductive layer. Generally, a thin interfacial barrier or blocking layer is sandwiched between the photoconductive layer and the substrate. The barrier layer may comprise any suitable electrically insulating material such as metallic oxide or organic resin.

The use of the poly(N-vinylcarbazole) containing bis(4-diethylamino-2-methylphenyl)phenylmethane allows one to take advantage of placing a photoconductive layer adjacent to a supporting substrate and protecting the photoconductive layer with a top surface which will allow for the transport of photo-generated holes from the photoconductor, and at the same time function to physically protect the photoconductive layer from environmental conditions. This structure can then be imaged in the conventional xerographic manner which usually includes charging, optical projection exposure and development.

In general, the advantages of the improved structure and method of imaging will become apparent upon consideration of the following disclosure of the invention; especially when taken in conjunction with the accompanying drawings wherein:

DETAILED DESCRIPTION OF THE DRAWINGS

Figure 1:
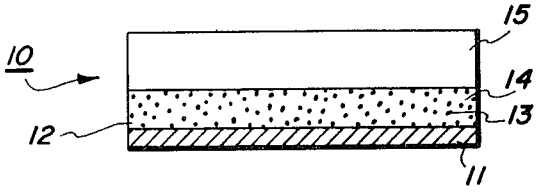
FIG. 1 is a schematic illustration of one embodiment of a device of the instant invention.

FIG. 1 designates imaging member 10 in the form of a plate which comprises a supporting substrate 11 having a binder layer 12 thereon, and a charge transport layer 15 positioned over binder layer 12. Substrate 11 is preferably made up of any suitable conductive material. Typical conductors include aluminum, steel brass, conductive polymers or the like. The substrate may be rigid or flexible and of any conventional thickness. Typical substrates include flexible belts or sleeves, sheets, webs, plates, cylinders and drums. The substrate or support may also comprise a composite structure such as a thin conductive coating contained on a paper base; a plastic coated with a thin conductive layer such as aluminum or copper iodide, or glass coated with a thin conductive coating of chromium or tin oxide.

In addition, if desired, an electrically insulating substrate may be used. In this instance, the charge may be placed upon the insulating member by double corona charging techniques well known and disclosed in the art. Other modifications using an insulating substrate or no substrate at all include placing the imaging member on a conductive backing member or plate and charging the surface while in contact with said backing member. Subsequent to imaging, the imaging member may then be stripped from the conductive backing.

Binder layer 12 contains photoconductive particles 13 dispersed randomly without orientation in binder 14. The photoconductive particles may consist of any suitable inorganic or organic photoconductor and mixtures thereof. Inorganic materials include inorganic crystalline photoconductive compounds and inorganic photoconductive glasses. Typical inorganic crystalline compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline from known as trigonal selenium. A method of making a photosensitive imaging device utilizing trigonal selenium comprises vacuum evaporating a thin layer of vitreous selenium onto a substrate, forming a relatively thicker layer of electrically active organic material over said selenium layer, followed by heating the device to an elevated temperature, e.g., 125° to 210° C., for a sufficient time, e.g., 1 to 24 hours, sufficient to convert the vitreous selenium to the crystalline trigonal form. Another method of making a photosensitive member which utilizes trigonal selenium comprises forming a dipersion of finely divided vitreous selenium particles in a liquid organic resin solution and then coating the solution onto a supporting substrate and drying, to form a binder layer comprising vitreous selenium particles contained in an organic resin matrix. Then the member is heated to an elevated temperature, e.g., 100° to 140° C., for a sufficient time, e.g., 8 to 24 hours, which converts the vitreous selenium to the crystalline trigonal form.

Typical organic photoconductive materials which may be used as charge generators include phthalocyanine pigments such as the X-form of metal-free phthalocyanine, described in U.S. Pat. No. 3,357,989 to Byrne et al; metal phthalocyanines such as copper phthalocyanine; quinacridones available from duPont under the tradename Monastral Red, Monastral Violet and Monastral Red Y; substituted 2,4-diamino-trizines disclosed by Weinberger in U.S. Pat. No. 3,445,227; triphenodioxazines disclosed by Weinberger in U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange.

Intermolecular charge transfer complexes such as a mixture of poly(N-vinylcarbazole) (PVK) and trinitrofluorenone (TNF) may be used as charge generating materials. These materials are capable of injecting photo-generated holes into the transport material.

Additionally, intramolecular charge transfer complexes, such as those disclosed in Limburg et al, U.S. patent applications Ser. No. 454,484, filed Mar. 25, 1974, now abandoned; Ser. No. 454,485, filed Mar. 25, 1974, now abandoned; Ser. No. 454,486, filed Mar. 25, 1974, now abandoned; Ser. No. 454,487, filed Mar. 25, 1974, now abandoned; Ser. No. 374,157, filed June 27, 1973, now abandoned; and Ser. No. 374,187, filed June 27, 1973, now abandoned; may be used as charge generation materials capable of injecting photo-generated holes into the transport materials.

The above list of photoconductors should in no way be taken as limiting, but are merely illustrative as suitable materials. The size of the photoconductive particles is not particularly critical; but particles in a size range of about 0.01 to 1.0 microns yield particularly satisfactory results.

Binder material 14 may comprise any electrically insulating resin such as those described in the abovementioned Middleton et al, U.S. Pat. No. 3,121,006. When using an electrically inactive or insulating resin, it is essential that there be particle-to-particle contact between the photoconductive particles. This necessitates that the photoconductive material be present in an amount of at least about 15 percent by volume of the binder layer with no limitation on the maximum amount of photoconductor in the binder layer. If the matrix or binder comprises an active material, the photoconductive material need only to comprise about 1 percent or less by volume of the binder layer with no limitation on the maximum amount of the photoconductor in the binder layer.

The thickness of the photoconductive layer is not critical. Layer thicknesses from about 0.05 to 20.0 microns have been found satisfactory, with a preferred thickness of about 0.2 to 5.0 microns yielding good results.

Active layer 15 comprises poly(N-vinylcarbazole) having dispersed therein from about 1 to about 25 percent by weight of bis(4-diethylamino-2-methylphenyl)-phenylmethane. The bis(4-diethylamino-2-methylphenyl)phenylmethane when added to the poly(N-vinylcarbazole) unexpectedly acts as an electrically active plasticizer for the poly(N-vinylcarbazole), that is, the bis(4-diethylamino-2-methylphenyl)phenylmethane when added to the poly(N-vinylcarbazole) allows the poly(N-vinylcarbazole) to remain flexible and non-brittle upon extensive cycling. Furthermore, unexpectedly the addition of bis(4-diethylamino-2-methylphenyl)-phenylmethane does not adversely affect the electrical properties of poly(N-vinylcarbazole). The poly(N-vinylcarbazole) remains capable of supporting the injection of photo-generated holes from the photoconductive layer and allows the transport of these holes through the organic layer to selectively discharge a surface charge. Therefore, active layer 15 must be capable of supporting the injection of photo-generated holes from the photoconductive layer and allowing the transport of these holes sufficiently through the active layer to selectively discharge the surface charge.

Electrically active layer or active layer when used to define layer 15, e.g., poly(N-vinylcarbazole) having bis(4-diethylmethylphenyl)phenylmethane dispersed therein, means that the material is capable of supporting the injection of photo-generated holes from the generating material and is capable of allowing the transport of these holes through the active layer in order to discharge a surface charge on the active layer.

In general, the thickness of active layer 15 should be from about 5 to 100 microns, but thicknesses outside this range can also be used.

Figure 2:
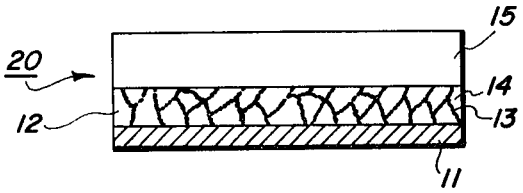
FIG. 2 illustrates a second embodiment of the device for the instant invention.

In another embodiment of the instant invention, the structure of FIG. 1 is modified to insure that the photoconductive particles are in the form of continuous chains through the thickness of binder layer 12. This embodiment is illustrated by FIG. 2 in which the basic structure and materials are the same as those in FIG. 1, except the photoconductive particles 13 are in the form of continuous chains. Layer 14 of FIG. 2 more specifically may comprise photoconductive materials in a multiplicity of interlocking photoconductive continuous paths through the thickness of layer 14, the photoconductive paths being present in a volume concentration based on the volume of said layer, of from about 1 to 25 percent. A further alternative for layer 14 of FIG. 2 comprises photoconductive material in substantially particle-to-particle contact in the layer in a multiplicity of interlocking photoconductive paths through the thickness of said member, the photoconductive paths being present in a volume concentration, based on the volume of the layer, of from about 1 to 25 percent. Alternatively, the photoconductive layer may consist entirely of a substantially homogeneous photoconductive material such as a layer of amorphous selenium, a selenium alloy or a powder or sintered photoconductive layers such as cadmium sulfoselenide or phthalocyanine. This modification is illustrated by FIG. 3 in which photoconductive member 30 comprises a substrate 11, having a homogeneous photoconductive layer 16 with an overlying active organic layer 15 which comprises poly(N-vinylcarbazole) having dispersed therein from about 1 to about 25 percent by weight of bis(4-diethylamino-2-methylphenyl)phenylmethane.

Figure 3:
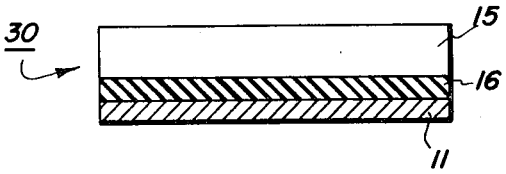
FIG. 3 illustrates a third embodiment of the device of the instant invention.
Figure 4:
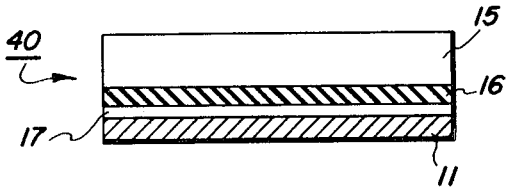
FIG. 4 illustrates a fourth embodiment of the device of the instant invention.

Another modification of the layered configuration described in FIGS. 1, 2 and 3 include the use of a blocking layer 17 at the substrate photoconductor interface. This configuration is illustrated by photoconductive member 40 in FIG. 4 in which the substrate 11 and photoconductive layer 16 are separated by a blocking layer 17. The blocking layer functions to prevent the injection of charge carriers from the substrate into the photoconductive layer. Any suitable blocking material may be used. Typical materials include nylon, epoxy and aluminum oxide.

It should be understood that in the layered configurations described in FIGS. 1, 2, 3 and 4, the photoconductive material preferably is selected from the group consisting of amorphous selenium, trigonal selenium, selenium alloys selected from the group consisting essentially of selenium-tellurium, selenium-tellurium-arsenic, and selenium-arsenic and mixtures thereof. The photoconductive material which is most preferred is trigonal selenium.

The active layer, i.e., charge transport layer which comprises poly(N-vinylcarbazole) having dispersed therein from about 1 to about 25 percent by weight of bis(4-diethylamino-2-methylphenyl)phenylmethane is non-absorbing to light in the wavelength region of intended use. This preferred range for xerographic utility is from about 4,000 to about 8,000 angstrom units. In addition, the photoconductive layer should be responsive to all wavelengths from 4,000 to 8,000 angstrom units if panchromatic responses are required. All photoconductor-active material combinations of the instant invention result in the injection and subsequent transport of holes across the physical interface between the photoconductor and the active material.

The reason for the requirement that the active layer, i.e., charge transport layer, should be transparent is that most of the incident radiation is utilized by the charge carrier generator layer for efficient photo-generation.

The charge transport layer, i.e., the poly(N-vinylcarbazole) containing bis(4-diethylamino-2-methylphenyl)-phenylmethane, will exhibit negligible, if any, discharge when exposed to a wavelength of light useful in xerography, i.e., 4,000 angstroms to 8,000 angstroms. Therefore, the obvious improvement in performance which results from the use of the two-phase system, can best be realized if the active transport layer of poly(N-vinylcarbazole) containing bis(4-diethylamino-2-methylphenyl)-phenylmethane as an electrically active plasticizer, as mentioned above, is substantially transparent of radiation in a region in which the photoconductor is to be used; as mentioned, for any absorption of desired radiation by the active material will prevent this radiation from reaching the photoconductive layer where it is much more effectively utilized. Therefore, the active layer which comprises poly(N-vinylcarbazole) having dispersed therein an electrically active plasticizer comprising from about 1 to about 25 percent by weight of bis(4-diethylamino-2-methylphenyl)phenylmethane, is a substantially non-photoconductive material which supports an injection of photo-generated holes from the photoconductive layer. This material is further characterized by the ability to transport the carriers even at the lowest electrical fields developed in electrophotography.

The active transport layer which is employed in conjunction with the photoconductive layer in the instant invention is a material which is an insulator to the extent that electrostatic charge placed on the active transport layer is not conducted in the absence of illumination, i.e., rate sufficient to prevent the formation and retention of an electrostatic latent image thereon.

In general, the thickness of the active layer should be from about 5 to 100 microns, but thicknesses outside this range can also be used. The ratio of the thickness of the active layer, i.e., charge transport layer, to the photoconductive layer, i.e., charge generator layer, should be maintained from about 2:1 to 200:1 and in some instances as great as 400:1.

The formula of bis(4-diethylamino-2-methylphenyl)-phenylmethane is as follows:

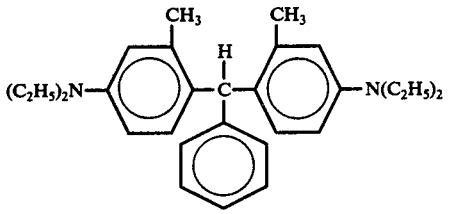

The following examples further specifically define the present invention with respect to a method of making a photoreceptor containing a photoconductive layer, i.e., charge generator layer, contiguous to an active organic layer, i.e., a charge transport layer comprising poly-N-vinylcarbazole having dispersed therein an electrically active plasticizer comprising from about 1 to about 25 percent by weight of 4,4'-bis(diethylamino)-2,2'-dimethyltriphenylmethane. The percentages are by weight unless otherwise indicated. The examples below are intended to illustrate various preferred embodiments of the instant invention.

EXAMPLE I

Preparation of bis(4-diethylamino-2-methylphenyl)phenylmethane

Into a 100 milliliter round bottom flask fitted with a mechanical stirrer and a dropping funnel is placed 8.85 grams (0.05 moles) of N,N-diethyl-m-toluidine and 3.0 grams (0.03 moles) of benzaldehyde and 10 milliliters of n-butanol containing 0.75 grams of concentrated sulfuric acid. The flask is flushed with nitrogen to remove air and refluxed for 18 hours with a nitrogen atmosphere. The material is then cooled to room temperature. A sufficient amount of sodium bicarbonate is added in order to neutralize the acid. 10 Milliliters of methanol is added whereby a yellowish white precipitation is formed. The yellowish white material is filtered out. The material may then be washed with cold methanol in order to remove the yellow color. The material may be recrystallized from either methanol or ethanol. In order to further purify the material, it may be put through a neutral alumina column. The material is eluted with benzene. The first material to be fractionated off of the column is a clear liquid. This liquid is placed in a rotary evaporator and the solvent is removed. The residue is either a clear liquid or a white solid. The material may be recrystallized using methanol or ethanol. White crystals are obtained. A 70 percent yield based upon the benzaldehyde is obtained. The product is vacuum dried in order to remove the remaining solvent.

EXAMPLE II

A photosensitive layered structure similar to that illustrated in FIG. 3 comprising an aluminized Mylar substrate, having a 1 micron layer amorphous selenium over the substrate, and a 22 micron thick layer of charge transport material comprising 25 percent by weight of bis(4-diethylamino-2-methylphenyl)-phenylmethane and 75 percent by weight of poly(N-vinylcarbazole) over the amorphous selenium layer, is prepared by the following technique A 1 micron layer of vitreous selenium is formed over an aluminized Mylor substrate by conventional vacuum deposition techniques such as those disclosed by Bixby in U.S. Pat. Nos. 2,753,278 and 2,970,906.

A charge transport layer is prepared by dissolving in 135 grams of methylene chloride, 3.3 grams of bis (4-diethylamino-2-methylphenyl)phenylmethane as prepared in Example I and 10 grams of poly(N-vinylcarbazole). The solution is mixed to form a homogeneous dispersion. A layer of the above mixture is formed on the vitreous selenium layer by applying the solution of material using a Bird Film Applicator. The coating is then vacuum dried at 40° C. for 18 hours to form a 22 micron thick dry layer of charge transport material. The plate is tested electrically by charging the plate to fields of 60 volts/micron and discharging them at a wavelength of 4,200 angstroms at $2 \times 10^{12}$ photons/cm$^2$ seconds. The member exhibits satisfactory discharge at the above fields and is capable of forming visible images. The member, i.e. belt, is then cycled for 1000 cycles in Xerox 9200 duplicating machine. After cycling, the member is examined and found to have (1) excellent flexibility, (2) no deterioration due to brittleness, and (3) no deterioration in electrical properties.

EXAMPLE III

A photosensitive layered structure similar to that illustrated in FIG. 3 comprises an aluminized Mylar substrate, having a 1 micron layer of amorphous selenium over the substrate, and a 22 micron thick layer of a charge transport material comprising 5 percent by weight of bis(4-ethylamino-2-methylphenyl)-phenylmethane and 95 percent by weight of poly(N-vinylcarbazole) over the amorphous selenium layer is prepared by the following technique:

A 1 micron layer of vitreous selenium is formed over an aluminized Mylar substrate by conventional vacuum deposition techniques such as those disclosed by Bixby in U.S. Pat. Nos. 2,753,278 and 2,970,906.

A charge transport layer is prepared by dissolving in 135 grams of methylene chloride, 0.53 grams of bis(4-diethylamino-2-methylphenyl)phenylmethane as prepared in Example I and 10 grams of poly(N-vinylcarbazole). The solution is mixed to form a homogeneous dispersion. A layer of the above mixture is formed on the vitreous selenium layer by applying this solution of material using a Bird Film Applicator. The coating is then dried at 40° C. for 18 hours to form a 22 micron thick dry layer of charge transport material. The plate is tested electrically by charging the plate to fields of 60 volts/micron and discharging them at a wavelenth of 4,200 angstroms at $2 \times 10^{12}$ photons/cm$^2$ seconds. The member exhibits satisfactory discharge at the above field and is capable of use in forming visible images. The member is tested by cycling 1000 times in a Xerox 9200 duplicating machine. The transport layer after the extensive cycling test remains flexible and exhibits no detrimental characteristics due to brittleness or cracking of the layer. The layer retains its excellent electrical properties.

EXAMPLE IV

A photosensitive layered structure similar to that illustrated in FIG. 3 comprises an aluminized Mylar substrate, having a 1 micron layer of amorphous selenium over the substrate, and a 22 micron thick layer of a charge transport material comprising 100 percent poly(N-vinylcarbazole) over the amorphous selenoium layer. The member is prepared by the following technique:

A 1 micron layer of vitreous selenium is formed over an aluminized Mylar substrate by conventional vacuum deposition techniques such as those disclosed by Bixby in U.S. Pat. Nos. 2,753,278 and 2,970,906.

A charge transport layer is prepared by dissolving in 75 grams of methylene chloride, 10 grams of poly(N-vinylcarbazole). A layer of the above mixture is formed on the vitreous selenium layer by applying the solution of material using a Bird Film Applicator. The coating is then dried at 40° C. for 18 hours to form a 22 micron thick dry layer of charge transport material. The plate is tested electrically by charging the plate to fields of 60 volts/micron and discharging them at a wavelength of 4,200 angstroms at $2 \times 10^{12}$ photons/cm$^2$ seconds. The plate exhibits satisfactory discharge at the above fields and is capable of use in forming visible images. The member is then placed into a Xerox 9200 duplicating machine and cycled for 1000 cycles and the physical properties, i.e., flexibility, of the transport material is examined. The flexibility of the transport material is unacceptable since it is found that the transport material is rigid and nonflexible. The layer is becoming brittle resulting in the formation of cracks in the surface of the layer which prevents acceptable imaging.

EXAMPLE V 0.328 Grams of poly(N-vinylcarbazole) and 0.0109 grams of 2,4,7-trinitro-9-fluorenone are dissolved in 14 ml of benzene. 0.44 grams of submicron trigonal selenium particles are added to the mixture. The entire mixture is ball milled on a Red-Devil paint shaker for 15 to 60 minutes in a 2 oz. amber colored glass jar containing 100 grams of ⅛ inch diameter steel shot. Approximately 2 microns thick layer of the slurry is coated on an aluminized Mylar substrate precoated with an approximately 0.5 micron flexclad adhesive interface which acts as a blocking layer. This member is evaporated at 100° C. for 24 hours and then slowly cooled to room temperature. The charge transport layer is prepared by dissolving 135 grams of methylene chloride 0.53 grams of bis(4-diethylamino-2-methylphenyl)-phenylmethane as prepared in Example I and 10 grams of poly(N-vinylcarbazole). A 22 micron layer of the above mixture is coated on the trigonal selenium layer by use of a Bird Applicator. The coating is then dried at 40° C. for 18 hours.

The plate is tested electrically by charging the plate to a field of 60 volts/micron and discharging it at a wavelength of 4,200 angstrom units at $2 \times 10^{12}$ photons/cm$^2$ seconds. The plate exhibits satisfactory discharge at the above fields and is capable of use in forming visible images.

Other modifications and ramifications of the present invention which appear to those skilled in the art upon reading of the disclosure are also intended to be within the scope of this invention.

What is claimed is:

1. A flexible recyclable xerograhic imaging member consisting essentially of a layer of photoconductive material and a contiguous layer of poly(N-vinylcarbazole) having dispersed therein from about 1 to about 25 percent by weight of bis(4-diethylamino-2-methylphenyl)phenylmethane as an electrically active plasticizer for said poly(N-vinylcarbazole) to cause said poly(N-vinylcarbazole) to retain its original flexibility fter extensive cycling in a xerographic process while maintaining the capability of supporting the injection and transportation of photogenerated holes, said photoconductive material exhibiting the capability of photogeneration of holes and injection of said holes and said layer of poly(N-vinylcarbazole) containing bis(4-diethylamino-2-methylphenyl)phenylmethane being substantially non-absorbing in the spectral region at which the photoconductive material generates and injects photo-generated holes but being capable of supporting the injection of photo-generated holes from said photoconductive material and transporting said holes through said layer of poly(N-vinylcarbazole) containing bis(4-diethylamino-2-methylphenyl)phenylmethane.

2. The member according to claim 1 wherein the photoconductive material is selected from the group consisting of amorphous selenium, trigonal selenium, selenium alloys selected from the group consisting of selenium-tellurium, selenium-tellurium-arsenic, and selenium-arsenic, and mixtures thereof.

3. The member according to claim 2 wherein the photoconductive material is trigonal selenium.

4. A flexible recyclable xerographic imaging member consisting essentially of a layer of photoconductive material dispersed in a resinous binder and a contiguous layer of poly(N-vinylcarbazole) having dispersed therein from about 1 to about 25 percent by weight of bis(4-diethylamino-2-methylphenyl)phenylmethane as an electrically active plasticizer for said poly(N-vinylcarbazole), to cause said poly(N-vinylcarbazole) to retain its original flexibility after extensive cycling in a xerographic process while maintaining the capability of supporting the injection and transportation of photogenerated holes, said photoconductive layer exhibiting the capability of photo-generation of holes and injection of said holes and said layer of poly(N-vinylcarbazole) containing bis(4-diethylamino-2-methylphenyl)-phenylmethane being substantially non-absorbing in the spectral region at which the photoconductive layer generates and injects photo-generated holes but being capable of supporting the injection of photo-generated holes from said photoconductive layer and transporting said holes through said layer of poly(N-vinylcarbazole) containing bis(4-diethylamino-2-methylphenyl)-phenylmethane.

5. The member according to claim 4 wherein the photoconductive material is selected from the group consisting of amorphous selenium, trigonal selenium, selenium alloys selected from the group consisting of selenium-tellurium, selenium-tellurium-arsenic, and selenium-arsenic, and mixtures thereof.

6. The member according to claim 5 wherein the inorganic photoconductive material is trigonal selenium.

7. A flexible recyclable xerographic imaging member consisting essentially of a photoconductive layer comprising an insulating organic resin matrix and a photoconductive material, with substantially all of the photoconductive material in said layer in a multiplicity of interlocking photoconductive continuous paths through the thickness of said layer, said photoconductive paths being present in a volume concentration, based on the volume of said layer, of from about 1 to 25 percent and a contiguous layer of poly(N-vinylcarbazole) having disprsed therein from about 1 to about 25 percent by weight of bis(4-diethylamino-2-methylphenyl)phenylmethane as an electrically active plasticizer for said poly(N-vinylcarbazole), to cause said poly(N-vinylcarbazole) to retain its original flexibility after extensive cycling in a xerographic process while maintaining the capability of supporting the injection and transportation of photo-generated holes, said photoconductive layer exhibiting the capability of photo-generation of holes and injection of said holes and said layer of poly(N-vinylcarbazole) containing bis(4-diethylamino-2-methylphenyl)phenylmethane being substantially non-absorbing in the spectral region at which the photoconductive layer generates and injects photo-generated holes but being capable of supporting the injection of photo-generated holes from said photoconductive layer and transporting said holes through said layer of poly(N-vinylcarbazole) containing bis(4-diethylamino-2-methylphenyl)phenylmethane.

8. The member according to claim 7 wherein the photoconductive material is selected from the group consisting of amorphous selenium, trigonal selenium, selenium alloys selected from the group consisting of selenium-tellurium, selenium-tellurium-arsenic, and selenium-arsenic and mixtures thereof.

9. The member according to claim 8 wherein the photoconductive material is trigonal selenium.

10. A flexible recyclable xerographic imaging member consisting essentially of a photoconductive layer comprising an insulating organic resin matrix containing therein photoconductive particles, with substantially all of the photoconductive particles being in substantial particle-to-particle contact in said layer in a multiplicity of interlocking photoconductive paths through the thickness of said layer, said photoconductive paths being present in a volume concentration, based on the volume of said layer, of from about 1 to 25 percent and a contiguous layer of poly(N-vinylcarbazole) having dispersed therein from about 1 to about 25 percent by weight of bis(4diethylamino-2-methylphenyl)phenylmethane as an electrically active plasticizer for said poly(N-vinylcarbazole) to cause said poly(N-vinylcarbazoe) to retain its origina flexibility after extensive cycling in a xerographic process while maintaining the capability of supporting the injection and transport of photogenerated holes, said photoconductive layer exhibiting the cpability of photo-generation of holes and injection of said holes and said layer of poly(N-vinylcarbazole) containing bis(4-diethylamino-2-methylphenyl)phenylmethane being substantially non-absorbing in the spectral region at which the photoconductive layer generates and injects photo-generated holes but being capable of supporting the injection of photo-generated holes from said photoconductive material and transporting said holes through said layer of poly(N-vinylcarbazole) containing bis(4-diethylamino-2-methylpheny)phenylmethane.

11. The member according to claim 10 wherein the photoconductive particles are selected from the group consisting of amorphous selenium, trigonal selenium, selenium alloys selected from the group consisting of selenium-tellurium, selenium-tellurium-arsenic, and selenium-arsenic and mixtures thereof.

12. The member according to claim 11 wherein the photoconductive particles are trigonal selenium.

13. A method of imaging which comprises:

a. providing a flexible recyclable xerographic imaging member consisting essentially of a photoconductive layer of photoconductive material dispersed in a resinous binder and a contiguous layer of electrically active material consisting essentially of poly(N-vinylcarbazole) having dispersed therein from about 1 to about 25 percent by weight of bis(4-diethylamino-2-methylphenyl)phenylmethane as an electrically active plasticizer for said poly(N-vinylcarbazole), to cause said poly(N-vinylcarbazole) to retain its original flexibility after extensive cycling in a xerographic process while maintaining the capability of supporting the injection and transportation of photogenerated holes, said photoconductive layer exhibiting the capability of photo-excited hole generation and injection and said layer of poly(N-vinylcarbazole) containing bis(4-diethylamino-2-methylphenyl)phenylmethane being substantially non-absorbing in the spectral region at which the photoconductive layer generates and injects photo-generated holes but being capable of supporting the injection of photo-generated holes from said photoconductive layers and transporting said holes through said layer of poly(N-inylcarbazole) containing bis(4-diethylamino-2-methylphenyl)-phenylmethane;

a. uniformaly electrostatically charging said member; followed by c. imagewise exposing said charged member to a source of activating radiation to which the photoconductive material dispersed in a resinous binder is absorbing and to which the layer of electrically active material is non-absorbing, whereby the photo-generated holes generated by said photoconductive material dispersed in a binder are injected into and are transported through said layer of poly(N-vinylcarbazole) containing bis(4-diethylamino-2-methylphenyl)phenylmethane to form a latent electrostatic image on the surface of said member.

14. The member according to claim 13 wherein the photoconductive material is selected from the group consisting of amorphous selenium, trigonal selenium, selenium alloys selected from the group consisting essentially of selenium-tellurium, selenium-tellurium-arsenic, and selenium-arsenic, and mixtures thereof.

15. A method of imaging which comprises:

a. providing a flexible recyclable xerographic imaging member consisting essentially of a layer of photoconductive material and contiguous layer of poly(N-vinylcarbazole) having dispersed therein from about 1 to about 25 percent by weight of bis(4-diethylamino-2-methylphenyl)phenylmethane as an electrically active plasticizer for said poly(N-vinylcarbazole), to cause said poly(N-vinylcarbazole) to retain its original flexibility after extensive cycling in a xerographic process while maintaining the capability of supporting the injection and transportation of photo-generated holes, said photoconductive material exhibiting the capability of photogeneration of holes and injection of said holes and said layer of poly(N-vinylcarbazole) containing bis(4-diethylamino-2-methylphenyl)phenylmethane being substantially non-absorbing in the spectral region at which the photoconductive material generates and injects photo-generated holes but being capable of supporting the injection of photogenerated holes from said photoconductive material and transporting said holes through said layer of poly(N-vinylcarbazole) containing bis(4-diethylamino-2-methylphenyl)phenylmethane;

b. uniformly electrostatically charging said member; followed by c. imagewise exposing said charged member to a source of activating radiation to which the photoconductive material is absorbing and to which the layer of poly(N-vinylcarbazole) containing bis(4-diethylamino-2-methylphenyl)phenylmethane is non-absorbing, whereby the photo-generated holes generated by said photoconductive material are injected into and are transported through said layer of poly(N-vinylcarbazole) containing bis(4-diethylamino-2-methylphenyl)phenylmethane to form a latent electrostatic image on the surface of said member.

16. The member according to claim 15 wherein the photoconductive material is selected from the group consisting of amorphous selenium, trigonal selenium, selenium alloys selected from the group consisting of selenium-tellurium, selenium-tellurium-arsenic and selenium-arsenic, and mixtures thereof.

17. A method of imaging which comprises:

a. providing a flexible recyclable xerographic imaging member consisting of a photoconductive layer comprising an insulating organic resin matrix and a photoconductive material, with substantially all of the photoconductive material in said layer in a multiplicity of interlocking photoconductive continuous paths through the thickness of said layer, said photoconductive paths being present in a volume concentration, based on the volume of said layer, of from about 1 to 25 percent and a contiguous layer of poly(N-vinylcarbazole) having dispersed therein from about 1 to about 25 percent by weight of bis(4-diethylamino-2-methylphenyl)phenylmethane as an electrically active plasticizer for said poly(N-vinylcarbazole), to cause said poly(N-vinylcarbazole) to retain its original flexibility after extensive cycling in a xerographic process while maintaining the capability of supporting the injection and transportation of photo-generated holes, said photoconductive layer exhibiting the capability of photo-generation of holes and injection of said holes and said layer of poly(N-vinylcarbazole) containing bis(4-diethylamino- 2-methylphenyl)phenylmethane being substantially non-absorbing in the spectral region at which the photoconductive layer generates and injects photo-generated holes but being capable of supporting the injection of photogenerated holes frm said photoconductive layer and transporting said holes through said layer of poly(N-vinylcarbazole) containing bis(4-diethylamino-2-methylphenyl)phenylmethane;

b. uniformly electrostatically charging said member; followed by c. imagewise exposing said charged member to a source of activating radiation to which the photoconductive material is absorbing and to which the layer of poly(N-vinylcarbazole) containing bis(4-diethylamino-2-methylphenyl)phenylmethane is non-absorbing, whereby the photo-generated holes generated by said photoconductive material are injected into and are transported through said layer of poly(N-vinylcarbazole) containing bis(4-diethylamino-2-methylphenyl)phenylmethane to form a latent electrostatic image on the surface of the member.

18. A method of imaging which comprises:

a. providing a flexible recyclable xerographic imaging member consisting essentially of a photoconductive layer comprising an insulating organic resin matrix containing therein photoconductive particles, with substantially all of the photoconductive particles being in substantial particle-to-particle contact in said layer in a multiplicity of interlocking photoconductive paths through the thickness of said layer, said photoconductive paths being present in a volume concentration, based on the volume of said layer, of from about 1 to 25 percent and a contiguous layer of poly(N-vinylcarbazole) having dispersed therein from about 1 to about 25 percent by weight of bis(4-diethylamino-2-methylphenyl)-phenylmethane as an electrically active plasticizer for said poly(N-vinylcarbazole), to cause poly(N-vinylcarbazole) to retain its original flexibility after extensive cycling in a xerographic process while maintaining the capability of supporting the injection and transportation of photo-generated holes, said photoconductive layer exhibiting the capability of photo-generation of holes and injection of said holes and said layer of poly(N-vinylcarbazole) containing bis(4-diethylamino-2-methylphenyl)-phenylmethane being substantially non-absorbing in the spectral region at which the photoconductive layer generates and injects photo-generated holes but being capable of supporting the injection of photo-generated holes from said photoconductive material and transporting said holes through said layer of poly(N-vinylcarbazole) containing bis(4-diethylamino-2-methylphenyl)phenylmethane;

b. uniformly electrostatically charging said member; followed by c. imagewise exposing said charged member to a source of activating radiation to which the photoconductive material is absorbing and to which the layer of poly(N-vinylcarbazole) containing bis(4-diethylamino-2-methylphenyl)phenylmethane is non-absorbing, whereby the photo-generated holes generated by said photoconductive material are injected into and are transported through said layer of poly(N-vinylcarbazole) containing bis(4-diethylamino-2-methylphenyl)phenylmethane to form a latent electrostatic image on the surface of the member.

* * * * *

UNITED STATES PATENT AND TRADEMARK OFFICE

CERTIFICATE OF CORRECTION

PATENT NO. : 4,053,311

DATED : October 11, 1977

INVENTOR(S) : William W. Limburg, John F. Yanus and Damodar M. Pai

It is certified that error appears in the above-identified patent and that said Letters Patent are hereby corrected as shown below:

Column 14, line 30 (Claim 1), "fter" should be --after--.
Column 15, line 27 (Claim 7), "disprsed" should be --dispersed--.
Column 16, line 1 (Claim 10), "(N-vinylcarbazoe)" should be --(N-vinylcarbazole)--.
Column 16, line 1 (Claim 10), "origina" should be --original--.
Column 16, line 5 (Claim 10), "cpability" should be --capability--.
Column 16, line 48 (Claim 13), "poly(N-inylcarbazole" should be --poly(N-vinylcarbazole)--.
Column 16, line 51 (Claim 13), "a. uniformaly" should be --b. uniformly--.
Column 18, line 5 (Claim 17), "frm" should be --from--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*